US005369917A

United States Patent [19]

Janssens

[11] Patent Number: 5,369,917

[45] Date of Patent: Dec. 6, 1994

[54] CLAMPING DEVICE FOR EXPLOSION PANELS

[75] Inventor: Henri Janssens, Hove

[73] Assignee: Stuvex International Naamloze Vennootschap

[21] Appl. No.: 30,108

[22] PCT Filed: Sep. 19, 1991

[86] PCT No.: PCT/EP91/01806

§ 371 Date: Mar. 10, 1993

§ 102(e) Date: Mar. 10, 1993

[87] PCT Pub. No.: WO92/06252

PCT Pub. Date: Apr. 16, 1992

[30] Foreign Application Priority Data

Oct. 2, 1990 [BE] Belgium ..... 9000933

[51] Int. Cl.[5] ..... E04B 1/98

[52] U.S. Cl. ..... 52/1; 52/202; 52/509; 52/764

[58] Field of Search ..... 49/31; 52/1, 202, 509, 52/698, 764, 483.1; 220/207, 208, 209, 327, 328, 89.1, 89.2

[56] References Cited

U.S. PATENT DOCUMENTS 4,656,793 4/1987 Fons ..... 52/1 X 4,787,180 11/1988 Robinson et al. ..... 52/1

FOREIGN PATENT DOCUMENTS 2065745 7/1981 United Kingdom ..... 52/1

*Primary Examiner*—Carl D. Friedman

*Assistant Examiner*—Kevin D. Wilkens

*Attorney, Agent, or Firm*—William A. Drucker

[57] ABSTRACT

A clamping device for stiff explosion panels for closing off a safety opening in a holder filled with powder, gas or vapor, where a frame is fastened around the safety opening and several inclined clip strips are provided between the frame and the sides of the explosion panel for pressing the explosion panel onto the frame, wherein the clamping device comprises plural upright connecting blocks, a housing for each connecting block which fits over the associated connecting block to cover the connecting block, two clamping edges in each housing lying opposite one another, the connecting blocks and housings being spaced apart, one of each of the connecting blocks and associated housing being fastened to the perimeter of the explosion panel and the other to the perimeter of the frame, and at least two diverging clip strips in each housing, one end of each strip being supported by the connecting block and the other end pressing on one of the clamping edges of the housing in order to connect the housing to the connecting block, and, in turn, the explosion panel to the holder.

6 Claims, 1 Drawing Sheet

CLAMPING DEVICE FOR EXPLOSION PANELS

The invention is for a clamping device for retaining an explosion panel on the safety opening of holders in which there is a powder, gas or vapour, which explosion panel in the event of excess pressure, for example resulting from an explosion in the holder, is thrown open or blown away, so that the holder sustains little or no damage.

European patent application EP-A-O 351 457 of applicant describes a clamping device of this sort in which use is made of a stiff explosion panel in stainless steel which is provided all around with a side with a clamping edge which is folded inwards, on which grip the free ends of several inclined clip strips which are directed towards said clamping strip and which are attached to a frame provided around the safety opening of the holder and thus press the explosion panel firmly to the frame.

When an explosion occurs in the holder, the explosion panel is raised by the generated pressure and the stiff clamping edge of the explosion panel bends the free ends of the clip strips upwards, causing the explosion panel to slide freely over the clip strips and be blown away from the safety opening.

A disadvantage of such an explosion panel with clamping edges is that the stainless steel from which the panel is made is an expensive material and that moreover the production of such a panel which must be pressed into a certain form in order to give it adequate stiffness is expensive. Another disadvantage is that dirt can easily lodge between the clip strips and the clamping edge of the panel, so that it is more difficult for the clip strips to react and only when the pressure on the explosion panel is greater than intended. Another disadvantage is that when the opening pressure of the explosion panel is high, the inclined clip strips must hold the clamping edge of the panel firmly against the edge of the safety opening, so that for blowing away the panel, the additional friction which arises during the raising of the panel between the panel and the frame provided around the safety opening, must be overcome. The opening pressure required for this is consequently difficult to predict.

From the U.S. Pat. No. 4,308,695 a pressure-relieving facade structure for a building is known. This structure has a plurality of slab-like elements, a plurality of retaining legs each extending from one of the slab-like elements toward the facade of the building and having a thickened clamping projection at its free end, and a plurality of elastic receiving elements attached to the facade of the building and releasably receiving the clamping projections of the retaining legs with elastic clamping action.

Also, this structure has the disadvantage that dirt can easily lodge between the different elements of the structure. Besides the elastic elements have the disadvantage that they are unsuitable for holding an explosion panel on the safety opening of a holder, because of the shape and the material of the elastic elements.

In order to remedy these disadvantages a clamping device has, pursuant to the chief characteristic of the invention, been realized which consists of several upright connecting blocks, for each connecting block a housing which fits over same for protecting the connecting block, in each housing two clamping edges which lie opposite one another, which clamping blocks and housings are mounted at a distance from one another, one of the two to the perimeter of the explosion panel and the others to the perimeter of the frame, and in each housing at least two diverging clip strips one end of which is mounted on the connecting block while the other end presses on one of the clamping edges of the housing for connecting the housing with the connecting block or the explosion panel with the holder.

The use of two diverging clip strips means that the resultant of the two pressures acting obliquely on the clamping edges is vertical, so that the whole is in equilibrium and the explosion panel is blown away vertically, so that furthermore all friction between the explosion panel and the frame fastened around the safety opening is avoided. Another advantage is that each individual clamping device is sheltered in a sealed housing, so that no problems with the accumulation of dirt need be feared and that the replacement of the clamping means is easy to carry out. Another major advantage is that this clamping device permits the use of a common and inexpensive composite panel such as used in building structures and which are less subject to deformation than explosion panels in stainless steel. Moreover such panels have extremely good thermal insulating characteristics and in many cases prevent the formation of condensation on the panel.

By way of example a more detailed description of a preferred but in no way limited embodiment of the clamping device pursuant to the invention follows below. This description refers to the attached drawings where:

Figure 1:
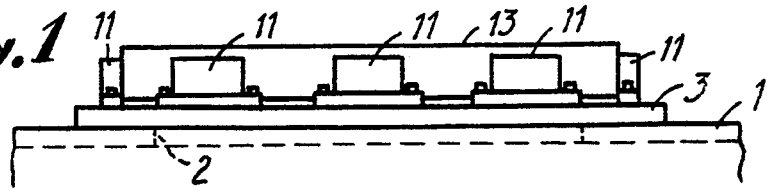
FIG. 1 shows a front elevation of the clamping device and the explosion panel mounted on the holder.
Figure 2:
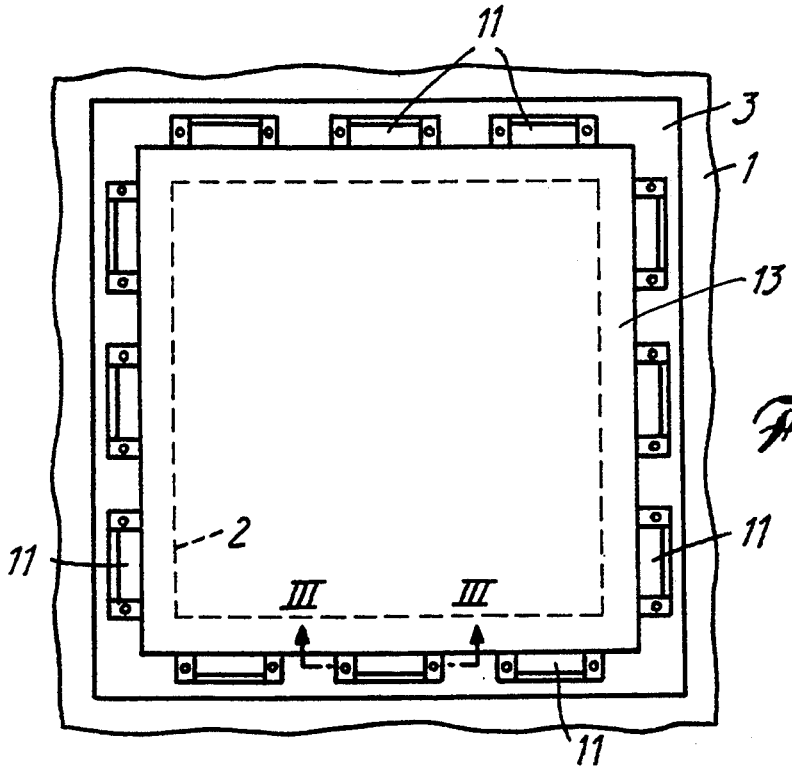
FIG. 2 shows a plan view of the same.
Figure 3:
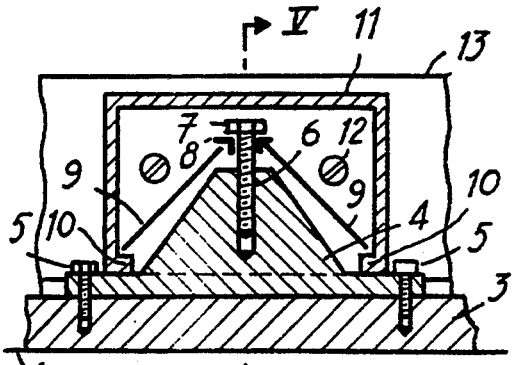
FIG. 3 shows an enlarged longitudinal section through one of the elements of the clamping device along line III—III in FIG. 2.
Figure 4:
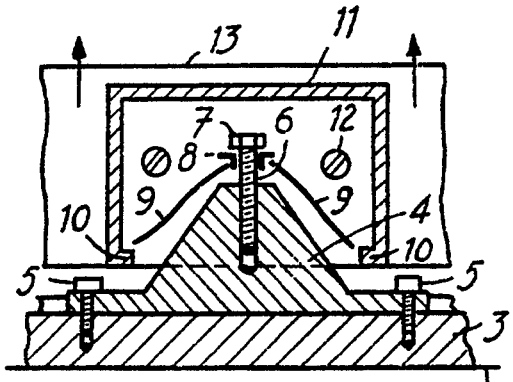
FIG. 4 shows the same longitudinal section as that in FIG. 3 but where the explosion panel is released from the holder.
Figure 5:
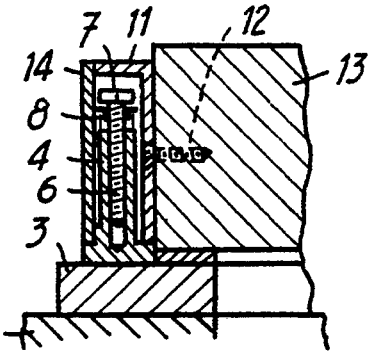
FIG. 5 shows a cross section of one element of the clamping device along line V—V in FIG. 3.

In these figures can be seen the holder 1 in which any sort of powder, gas or vapour is present and which is provided with a safety opening 2 which must be closed. Around this opening a frame 3 is mounted on the holder in any way whatsoever. On this frame several upright connecting blocks 4 are mounted at a distance from one another by means of screws 5. Each connecting block 4 has as threaded opening 6 in which the height of a screw 7 can be set. This screw passes through an opening which is provided in a bearing element 8 the cross section of which is an inverted L and on which the head of screw 7, which serves to preset the tension, can exert pressure. One end of each of the two diverging straight clip strips 9 which lie in a plane which runs angled to the longitudinal direction of frame 3 engages in this bearing element 8. The other end of each clip strip 9 engages in a clamping edge 10 provided on the lower edge of each end surface of a housing 11 the bottom surface of which is open and which fits over the connecting block 4 and closes against its base, so that the whole is adequately protected against deposits of dirt. Each housing 11 is attached by one side surface by means of screws 12 to the side of a stiff explosion panel 13 which consists by preference of a composite panel such as used in building structures. Each housing 11 is provided with a cover 14 which enables the clip strips 9 to be easily installed in the housing and the screw 7 and the supporting element 8 to be adjusted in height so that preset tension of the clip strips 9 and consequently the clamping force between the housing 11 and the connecting block is adjustable. The pressure at which the explosion panel will be blown away is, determined by the buckling strength of the clip strips and thus largely depends on the material selected and the dimensions of the clip strips.

When an explosion occurs in the holder 1, the generated pressure exerts upward pressure on the explosion panel 13, which pressure is transferred by the housings 11 with clamping edges 10 to the clip strips 9. When the buckling strength of the clip strips 9 is exceeded, these strips buckle, so that the explosion panel 13 with the housings 11 slides vertically over the connecting blocks 4 and is blown away from the safety opening 2 of the holder 1. After a mild explosion the explosion panel is usually not damaged and it is sufficient to replace the clip strips and/or the connecting blocks 4 and the housings in order to return the clamping device to service.

It goes without saying that the form, the number and the dimensions of the components described above may differ and that some of these components might be replaced by others which are intended for the same purpose. Thus instead of straight clip strips use could be made of pre-formed single or multiple clip strips.

I claim:

1. A clamping device for stiff explosion panels for closing off a safety opening in a holder filled with powder, gas or vapor, where a frame is fastened around the safety opening and several inclined clip strips are provided between the frame and the sides of the explosion panel for pressing the explosion panel onto the frame, characterized by the fact that: the clamping device comprises plural upright connecting blocks, for each connecting block a housing which fits over the associated connecting block to cover the connecting block, in each housing two clamping edges lying opposite one another, said connecting blocks and housings being spaced apart, one of each of said connecting blocks and associated housing being fastened to the perimeter of the explosion panel and the other to the perimeter of the frame, and in each housing at least two diverging clips strips, one end of each strip being supported by the connecting block and the other end pressing on one of the clamping edges of the housing in order to connect the housing to the connecting block, and, in turn, the explosion panel to the holder.

2. Clamping device according to claim 1, characterized by the fact that the housings are fastened with their rear surfaces to the sides of the explosion panel, whereby the diverging clip strips run transverse to the back surface of each housing.

3. Clamping device according to claim 1, characterized by the fact that the lower edge of each end surface of the housing is finished in an inward turning clamping edge on which one end of a clip strip rests.

4. Clamping device according to claim 1, characterized by the fact that a tension adjuster is provided between each connecting block and the clip strips for presetting the tension of the clip strips.

5. Clamping device according to claim 4, characterized by the fact that the tension adjuster consists of a vertically adjustable screw in the connecting block and a bearing element on which the head of the screw exerts a pressure and in which one of the ends of each clip strip rests.

6. Clamping device according to claim 1, characterized by the fact that the explosion panel consists of a composite panel structure.

* * * * *